United States Patent [19]

Sjönell

[11] 4,394,943

[45] Jul. 26, 1983

[54] TILTING TRAP CHAMBER

[76] Inventor: Göran Sjönell, 11 Askrikevägen, Lidingö, Sweden

[21] Appl. No.: 340,032

[22] Filed: Jan. 18, 1982

Related U.S. Application Data

[63] Continuation of Ser. No. 147,380, May 7, 1980, abandoned.

[30] Foreign Application Priority Data

May 16, 1979 [SE] Sweden ..... 7904286

[51] Int. Cl.[3] ..... G01F 11/26

[52] U.S. Cl. ..... 222/456; 222/564

[58] Field of Search ..... 222/454, 455, 456, 457, 222/564

[56] References Cited

U.S. PATENT DOCUMENTS

| | | | |
|---|---|---|---|
| 2,023,537 | 12/1935 | Myers | 222/455 |
| 2,243,452 | 5/1941 | Bickel et al. | 222/455 |
| 2,739,741 | 3/1956 | Barnett | 222/455 |
| 3,221,951 | 12/1965 | Souza | 222/456 |

FOREIGN PATENT DOCUMENTS

| | | | |
|---|---|---|---|
| 86659 | 9/1964 | France | 222/456 |
| 883071 | 11/1961 | United Kingdom | 222/456 |

*Primary Examiner*—David A. Scherbel
*Attorney, Agent, or Firm*—Sherman & Shalloway

[57] ABSTRACT

The invention relates to a package for powdered material, from which package it is possible to discharge equally large predetermined measured amounts of the material, irrespective of the amount remaining in the package. This is possible in that the package is provided with guide surfaces 1,2,3, at one end, which surfaces form a space, which by a gap (8) is separated from the main space of the package and which upon turning of the package from upside down position to upright position is filled with the intended accurate amount of material, which material is discharged through the opening (5) at repeated turning to upside down position.

8 Claims, 4 Drawing Figures

TILTING TRAP CHAMBER

This is a continuation of application Ser. No. 147,380, filed May 7, 1980, now abandoned.

This invention relates to a package for powdered material, and especially such to be discharged from the package in well-measured amounts, as for example bulk laxative, i.e. laxative in powdered state.

The conventional type of package, consisting of a jar with lid and dosing spoon, shows several disadvantages, both from a hygienic point of view, implying contamination risk for the drug due to the fact that the dosing spoon, table-spoon or the like repeatedly are inserted into the drug, and also because it may be difficult for old and weak patients to remove the lid from the jar as well as to see and measure the correct amount of drug. Improvements have been made, and at present also throw-away bags are available. These, however, are expensive and difficult to open by many old and weak patients. So far, no efficient method has been suggested for solving the aforesaid difficulties.

The said difficulties have been solved by the present invention, in that it has been given the characterizing features defined in the attached claims.

The invention is described in greater detail in the following, reference being had to the accompanying drawing, in which FIG. 1 shows a cross-sectional view of the package of the present invention in its upright position.

Figure 4:
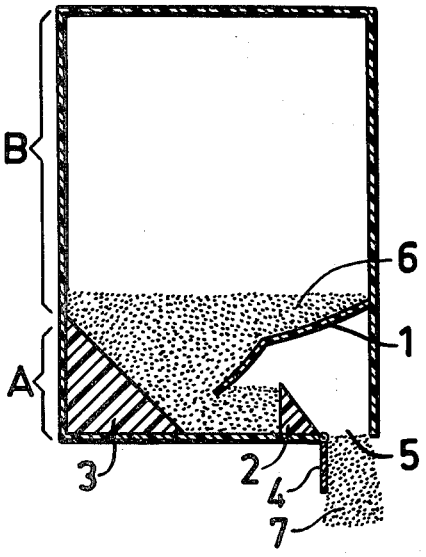

FIG. 4 shown a cross-sectional view of the package of the present invention with the measured amount of material being dispensed.

The Figures are vertical sections of the packge containing a bulk laxative 6. The package shown by way of example is assumed to consist of the jar or container B proper and of a lid A attached thereon. The attachment per se of the lid does not constitute a measure of inventive merit and, therefore, is neither shown nor described here in detail. Within the package, i.e. in the present case on the inside of the lid, an oblique plate 1 extends between the longitudinal sides of the lid and one end wall and is located below a discharge opening 5 in the lid, which opening extends between the longitudinal sides and is covered by a freely pivotal closure cover 4, which as can be seen is suspended at a joint in the lid A. In above said plate 1 a downward directed flap 2 is provided in the way illustrated in the drawing and extends between the long sides of the lid. Said flap has such a height that a passage 8 is formed between the flap 2 and the plate 1. In the embodiment shown, the free edge of the plate 1 is located on a level higher than the lower edge of the flap 2 and thereby prevents material from flowing directly through the passage 8 without first being stopped by the flap 2, when the package is being turned. The said level, however, depends on the material and its flow properties. The lid A is provided on the inside of its side opposed to said plate with a shield 3, which extends between the long sides of the lid and from the short side of the lid to the top side thereof. The shield 3 and flap 2 are shown in the drawing to be of a homogenous material, but of course may consist of suitably jointed-in sheets.

The plate 1, flap 2 and shield 3 together form a channel or passage, through which the powdered laxative can flow when the jar is turned upside down.

Figure 1:
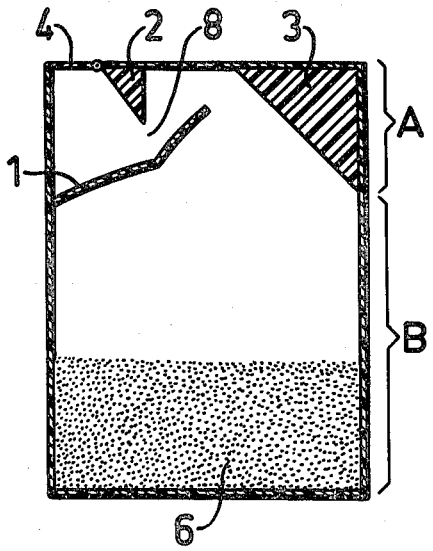

The function of the plate 1, flap 2 and shield 3 will become apparent from the following, where it is explained how the package is utilized in connection with the dispensing of a precise amount of laxative. In FIG. 1 the package is shown in upright position, the laxative lying on the jar bottom, for example in an amount as indicated. The jar then is turned upside down to the position shown in FIG. 2, whereby the laxative positions itself upon the plate 1 and shield 3 and flows down on the lid, filling the same all the way to the flap 2. Due to gravitation, the closure cover 4 opens. A definite amount of laxative, thus, has filled the lid between the plate 1, flap 2 and shield 3. The package then is turned to upright position according to FIG. 3, by turning the package clockwise. When the package as said is being turned, the definite amount of laxative flows through the passage 8 and positions itself upon the plate 1 in the pocket formed by the plate and the end wall of the lid. The said definite amount is designated by 7. The remaining drug again positions itself on the bottom of the package. The closure cover 4 again closes the opening. The package again is turned, counter-clockwise, to upside down position according to FIG. 4, in which position the closure cover 4 automatically opens, and the measured laxative amount 7 flows out through the opening 5. At the same time a new determined amount of laxative positions itself between the flap 2 and shield 3, as described above with reference to FIG. 2.

Figure 3:
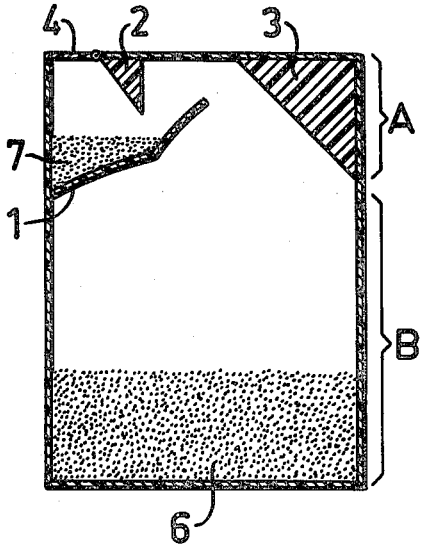
FIG. 3 shows a cross-sectional view of the package of the present invention having a measured amount of material ready to be dispensed.

When the definite amount 7 has been discharged from the package, the package again is turned to the position shown in FIG. 3, whereafter for a new measuring the package is turned counter-clockwise to the position shown in FIG. 4, and a new measured amount of laxative leaves the package.

From the aforesaid is apparent that the package only has to be taken in one hand, for example the right hand, and be turned up and down between the positions shown, without requiring a change of the grasp. For every turning up and down of the package, an accurately measured amount of drug leaves through the opening 5. This can continue as long as there is drug in the package, except of course when there is only so little left in the package, that the pocket formed between the plate 1 and the lid wall is not filled completely, and the amount is not sufficient to constitute an entire dose.

The present invention, thus, renders it possible to dispense an accurately measured amount as long as there is enough powdered material in the package. Such dispensing has not been possible with conventional measuring packages, at which the measured amount changes as the amount contained in the package changes. The present invention does not require any measuring vessel nor must the package be opened. The risk of contamination is thereby eliminated.

As shown in FIG. 1, the plate 1 is formed with two portions extending angularly relative to one another. This is for practical reasons, namely to prevent the pocket between the plate 1 and the lid end wall from becoming too deep or too "pointed", which would imply that the material can adhere in the pocket.

Figure 2:
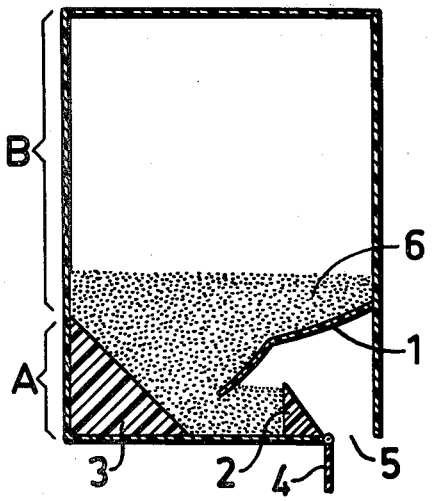
FIG. 2 shows a cross-sectional view of the package of the present invention in its inverted position.

By said angular arrangement of the plate, also a more distinct control of the material (good angle of repose) in the positions according to FIGS. 2 and 4 is obtained; at the same time the height of the passage 8 and the distance between the upper portion of the lid and the free edge of the plate 1 can be determined independently of the extension of the plate in general.

It is possible, of course, within the scope of the invention to change in inclination of the plate, the shape of the flap and also the inclination of the shield, depending on the material to be contained in the container and on the measured amount to be discharged threfrom. The package may also be formed in one piece, as a throw-away package, or be provided with a bottom opening for filling. The package, of course, may have forms other than the one shown. One requirement, however, is that the wall portions above the plate connect continuously to the edges of the discharge opening, and that the flap has a surface, which also connects to the opening, as is the case at the embodiment described.

What is claimed is:

1. A container for dispensing measured amounts of a powdered material comprising a top wall, a bottom wall and sidewalls connecting said top and bottom walls, said top wall being provided with a discharge opening, a partition being disposed adjacent said discharge opening and extending downwardly from the bottom surface of said top wall, a first inclined wall extending upwardly from the sidewall below said discharge opening, said first inclined wall having one end attached to said sidewall and the other end being free and extending upwardly beyond said partition below the bottom surface of said top wall, and a second inclined wall extending downwardly from said bottom surface of the top wall towards the sidewall opposite to said first inclined wall, openings being provided between said first and second inclined walls, between said free end of said first inclined wall and said bottom surface of said top wall, and between the lower end of said partition and said first inclined wall form a flowpath for said powdered material, and said second inclined wall preventing the presence of a column of the powdered material above the opening between said free end of said first inclined wall and said bottom surface of said top wall when said container is tilted during dispensing of said powdered material.

2. The container of claim 1 wherein said first inclined wall is provided with a bend located below said partition, with the portion of said first inclined wall attached to the sidewall being less steeply inclined upward then the remaining portion of said inclined wall.

3. The container of claim 1 wherein a cover for said discharge opening is provided, said cover being connected to said top wall.

4. The container of claim 1 wherein the free end of said first inclined wall extends upwardly to an elevation above the lower end of said partition.

5. A device for dispensing measured amounts of a powdered material from a container comprising a top wall and sidewalls extending from the bottom surface of said top wall, a discharge opening disposed in the top wall, a partition disposed adjacent said discharge opening and extending downwardly from said bottom surface of the top wall, a first inclined wall extending upwardly from the sidewall below the discharge opening, said first inclined wall having one end attached to said sidewall and the other end being free and extending upwardly beyond said partition and below said bottom surface of the top wall, and a second inclined wall extending downwardly from said bottom surface of the top wall towards the sidewall opposite to said first inclined wall, openings being provided between said first and second inclined walls, between said free end of said first inclined wall and said bottom surface of said top wall, and between the lower end of said partition and said first inclined wall to form a flowpath for said powdered material, said second inclined wall preventing the presence of a column of the powdered material above the opening between said free end of said first inclined wall and said bottom surface of said top wall when said container is tilted during dispensing of said powdered material.

6. The device of claim 5 wherein said first inclined wall is provided with a bend located below said partition, with the portion of said first inclined wall attached to the sidewall being less steeply inclined upward than the remaining portion of said inclined wall.

7. The device of claim 5 wherein a cover for said discharge opening is provided, said cover being connected to said top wall.

8. The device of claim 5 wherein the free end of said first inclined wall extends upwardly to an elevation above the lower end of said partition.

* * * * *